US011831075B2

(12) United States Patent
Stirland et al.

(10) Patent No.: US 11,831,075 B2
(45) Date of Patent: Nov. 28, 2023

(54) ARRAY-FED REFLECTOR ANTENNA

(71) Applicants: Airbus Defence and Space Limited, Stevenage (GB); Airbus Defence and Space SAS, Les Mureaux (FR)

(72) Inventors: Simon Stirland, Stevenage (GB); Denis Fragnol, Les Mureaux (FR)

(73) Assignee: Airbus Defence and Space Limited, Stevenage (GB)

( * ) Notice: Subject to any disclaimer, the term of this patent is extended or adjusted under 35 U.S.C. 154(b) by 0 days.

(21) Appl. No.: 17/259,918

(22) PCT Filed: Jul. 12, 2019

(86) PCT No.: PCT/EP2019/068880
§ 371 (c)(1),
(2) Date: Jan. 12, 2021

(87) PCT Pub. No.: WO2020/012007
PCT Pub. Date: Jan. 16, 2020

(65) Prior Publication Data

US 2021/0296780 A1 Sep. 23, 2021

(30) Foreign Application Priority Data

Jul. 12, 2018 (GB) ..... 1811459
Sep. 25, 2018 (EP) ..... 18290107

(51) Int. Cl.
*H01Q 19/17* (2006.01)
*H01Q 3/16* (2006.01)
(Continued)

(52) U.S. Cl.
CPC ..... *H01Q 19/17* (2013.01); *H01Q 3/16* (2013.01); *H01Q 3/18* (2013.01); *H01Q 3/20* (2013.01); *H01Q 15/147* (2013.01); *H01Q 1/288* (2013.01)

(58) Field of Classification Search
CPC .. H01Q 3/16; H01Q 3/18; H01Q 3/20; H01Q 15/147; H01Q 15/167; H01Q 15/166
See application file for complete search history.

(56) References Cited

U.S. PATENT DOCUMENTS 4,562,441 A 12/1985 Beretta et al.
5,949,370 A * 9/1999 Smith ..... H04B 7/18519 342/354

(Continued)

FOREIGN PATENT DOCUMENTS

EP 0845833 A2 6/1998
EP 0845834 A2 6/1998

(Continued)

OTHER PUBLICATIONS

Thesis No. 40-2007, Oct. 12, 2007.

(Continued)

*Primary Examiner* — Ab Salam Alkassim, Jr.
(74) *Attorney, Agent, or Firm* — Blank Rome LLP

(57) ABSTRACT

An Array-Fed Reflector (AFR) antenna assembly is provided comprising an AFR antenna comprising a feed array a reflector, and a mechanism for moving a position of the reflector relative to a position of the feed array such that a focal region of the reflector is movable with respect to the position of the feed array.

17 Claims, 3 Drawing Sheets

(51) Int. Cl.

| | |
|---|---|
| ***H01Q 15/14*** | (2006.01) |
| ***H01Q 3/20*** | (2006.01) |
| ***H01Q 3/18*** | (2006.01) |
| *H01Q 1/28* | (2006.01) |

(56) References Cited

U.S. PATENT DOCUMENTS

| | | | | |
|---|---|---|---|---|
| 6,414,646 | B2 | 7/2002 | Luh | |
| 6,580,399 | B1 | 6/2003 | Ballinger et al. | |
| 7,737,903 | B1 * | 6/2010 | Rao | H01Q 5/55 343/753 |
| 8,373,589 | B2 * | 2/2013 | McLaughlin | H01Q 3/08 342/26 R |
| 10,587,055 | B1 * | 3/2020 | Rao | H01Q 21/064 |
| 2003/0142014 | A1 * | 7/2003 | Rao | H01Q 5/55 455/13.3 |
| 2004/0108961 | A1 * | 6/2004 | Hay | H01Q 15/147 343/781 CA |
| 2004/0189538 | A1 * | 9/2004 | Rao | H01Q 1/288 343/757 |
| 2005/0200546 | A1 * | 9/2005 | Amyotte | H01Q 17/00 343/779 |
| 2012/0229355 | A1 * | 9/2012 | Scolamiero | H01Q 1/08 343/834 |
| 2014/0333491 | A1 * | 11/2014 | Behroozi | H01Q 3/16 343/706 |
| 2016/0172756 | A1 * | 6/2016 | Goyette | H01Q 19/13 342/373 |
| 2017/0338556 | A1 * | 11/2017 | Yi | H01Q 15/167 |
| 2018/0191078 | A1 * | 7/2018 | Moore | H01Q 19/065 |
| 2018/0277948 | A1 * | 9/2018 | Brown | H01Q 19/10 |
| 2020/0274611 | A1 * | 8/2020 | Mendelsohn | H04B 7/2041 |
| 2022/0328977 | A1 * | 10/2022 | Hikido | H01Q 3/20 |

FOREIGN PATENT DOCUMENTS

| | | | |
|---|---|---|---|
| EP | 1902492 | B1 | 12/2014 |
| FR | 2947103 | A1 | 12/2010 |
| FR | 2956927 | A1 | 9/2011 |
| JP | H5-273340 | A | 10/1993 |
| JP | H06-37535 | A | 2/1994 |
| JP | H08-32346 | A | 2/1996 |
| JP | 2006304196 | A | 11/2006 |
| WO | WO 02/07256 | A2 | 1/2002 |
| WO | WO 2018/190794 | A1 | 10/2018 |

OTHER PUBLICATIONS https://en.wikipedia.org/w/index.php?title=Reflector_(antenna)&oldid=844659298.

Cooley, Phased Array-Fed Reflector (PAFR) Antenna Architectures for Space-Based Sensors, IEEE, 2015, 978-1-4799-5380.

English translation of Notice of Opposition.

English translation; Kahrilas, P.J., "Design Manual of Electronically Scanned Radar," 1st edition, Jul. 1978 (extract); 2 pages.

Kahrilas, P.J., "Design Manual of Electronically Scanned Radar,"; 1st edition, Jul. 1978; 35 pages.

China Board of Appeal; Board Opinion dated Nov. 29, 2022; 6 pages.

English translation; China Board of Appeal; Board Opinion dated Nov. 29, 2022; 7 pages.

* cited by examiner

ARRAY-FED REFLECTOR ANTENNA

RELATED APPLICATIONS

This application is a national phase application of PCT/EP2019/068880, filed Jul. 12, 2019, which claims priority to Great Britain Application No. 1811459.5, filed Jul. 12, 2018 and European Application No. 18290107.4, filed Sep. 25, 2018. The entire contents of those applications are incorporated herein by reference.

FIELD OF THE INVENTION

The present invention relates to a reconfigurable antenna, and particularly to a zoomable array-fed reflector (AFR) antenna.

TECHNICAL BACKGROUND

An AFR antenna makes use of a reflector to transmit or receive radio frequency (RF) signals, and an array of feed horns conveying the RF signals between the reflector and one or more analogue or digital beamforming networks. Each feed generates its own individual beamlet, and each of the antenna's beams is built up by superposition of beamlets from individual feeds. The position of a feed determines the direction of its beamlet.

AFR antennas are commonly used for L-, S-, Ka- and Ku-band communications, and enable the generation of multiple flexible beams within a limited field of view, using fewer feeds (hence simpler beamforming) than would be necessary in a direct radiating phased array antenna of the same aperture size.

An AFR antenna typically has a configuration which depends on the particular application of the antenna. Fully focused AFR systems (FAFR) are those in which the feed array is arranged at the focal plane of the reflector, while fully defocused systems (Imaging Phased Array systems, IPA) are those in which the feed array is positioned much closer to the reflector than its focal plane. The particular configuration to be used depends on one or more of a number of parameters specified by the mission requirements, e.g. the power available per spot beam ("power pooling"), beamformer complexity associated with the formation of each individual beam, the total number of feeds needed for a given directivity requirement, reflector aperture size and so on. Intermediate configurations between FAFR and IPA may also be used, referred to herein as "defocused" AFR (DAFR) systems.

SUMMARY OF INVENTION

Embodiments of the present invention provide an AFR assembly with a zoomable reflector to enable reconfiguration of the AFR antenna. The zoomable reflector of such embodiments, achieved via a mechanism for moving the position of the reflector relative to the position of the feed array, introduces in-orbit flexibility in the control of the relative position between the focal region of the reflector and the position of the feed array.

According to an aspect of the present invention, there is provided an AFR antenna assembly comprising an AFR antenna comprising a feed array a reflector, and a mechanism for moving a position of the reflector relative to a position of the feed array such that a focal region of the reflector is movable with respect to the position of the feed array.

The mechanism may comprise a telescopic arm coupling the reflector to a feed array mount, such that the reflector is zoomable relative to the feed array.

The telescopic arm may be arranged to zoom the reflector such that the AFR antenna is configurable as a fully focused AFR, a fully defocused AFR, and a partially defocused AFR.

The reflector has a size configured based on a maximum distance between the reflector and the feed array provided by the telescopic arm.

The mechanism may comprise means for tilting the orientation of the reflector relative to the orientation of the feed array.

The AFR antenna assembly may further comprise means for applying a shaping function to the surface of the reflector, wherein the means for applying a shaping function comprise one or more actuators coupled to one or more movable sections of the reflector surface.

According to another aspect of the present invention, there is provided a system comprising an AFR antenna assembly as defined above, and a control means for receiving a signal from a ground station for controlling driving of the mechanism.

The system may further comprise optimisation means for determining an optimum shaping function for the surface of the reflector based on the relative position of the reflector and the feed array.

For applications with dynamically changing requirements, the same AFR antenna may not be suitable for use every time the requirement changes. Therefore embodiments of the present invention advantageously enable a re-configurable AFR antenna system to meet different mission requirements in comparison with statically-configured arrangements of the prior art.

BRIEF DESCRIPTION OF DRAWINGS

Embodiments of the present invention will be described by way of example only with reference to the following figures, in which.

DETAILED DESCRIPTION

Figure 1:
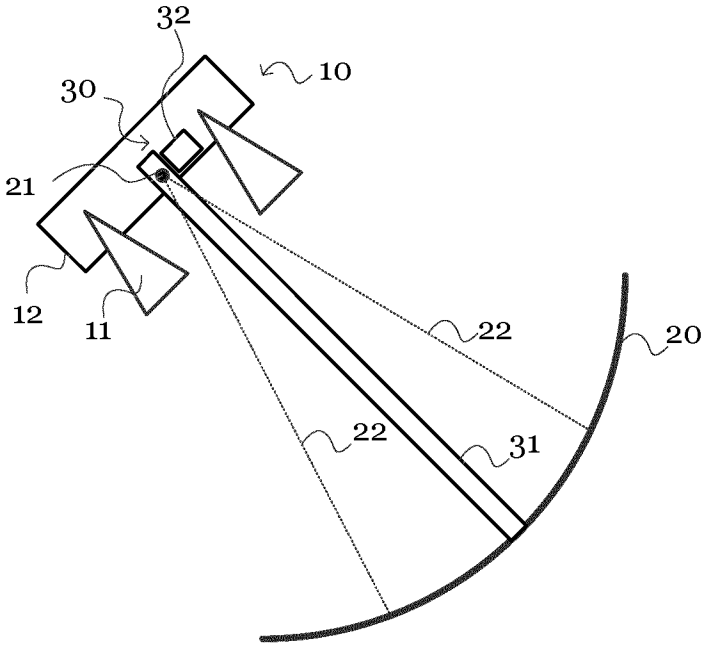
FIG. 1 illustrates an AFR assembly according to embodiments of the present invention in a fully focused configuration.

FIG. 1 illustrates an AFR assembly according to embodiments of the present invention. The AFR assembly comprises an AFR antenna, which includes a feed array 10 and a reflector 20. The feed array 10 comprises a plurality of feed horns 11 which interface with beamforming networks (not shown) in order to enable transmission or reception of RF signals via the reflector 20. The size of the feed horns 11 relative to the reflector 20, is exaggerated for ease of explanation. The AFR assembly is for use in a satellite and may be coupled to any suitable satellite which processes and routes incoming or outgoing RF signals via the reflector 20.

In operation, the required beams for the antenna are synthesised by appropriately weighting contributions from particular subsets of the feed array 10, taking into account requirements on beam gain, sidelobe levels and so on. As an example, the Inmarsat 4 antenna has an array of 120 feeds, generating a total close to 250 beams, each making use of contributions from up to about 20 of the 120 elements. In this type of antenna, the envelope of the feed array is similar to the overall coverage shape, since each element generates a beamlet whose direction is determined by the element's physical position in the array. Therefore the Inmarsat 4 feed array is approximately circular, as the antenna is required to create a number of beams covering the visible earth.

The reflector 20 in the configuration illustrated in FIG. 1 is a paraboloidal reflector, for simplicity of description, having a focal point 21 (illustrated by the convergence of two signal paths 22). With a paraboloidal reflector 20, the shape of the feed array 10 matches the shape of the overall antenna coverage. The AFR assembly further comprises a mechanism 30 for moving the position of the reflector 20 relative to the position of the feed array 10, such that the focal point 21 of the reflector is movable with respect to the position of the feed array 10.

In the illustrated embodiments, the mechanism 30 takes the form of a telescopic arm 31 or boom coupling the reflector 20 to a mounting surface 12 of the feed array 10, such that the reflector 20 is movable with respect to the feed array 10 along the direction of the longitudinal extent of the arm 31. The telescopic arm 31 is driven by an actuator 32, powered, for example, from the satellite payload, under the control of a control signal received from a control means, such as a control module on-board a satellite payload (not shown) to which the AFR assembly is coupled, or directly from a ground station, received via the uplink of the AFR antenna, or from another satellite in a constellation in which the AFR antenna is configured. The control signal enables reconfiguration of the AFR antenna in-orbit.

In the illustrated embodiments, the actuator 32 is arranged at the mounting surface 12 of the feed array 10, such that the reflector 20 is movable towards or away from the feed array 10 by the respective contraction or expansion of the telescopic arm 31.

The configuration of FIG. 1 illustrates the reflector 20 positioned such that the feed array 10 lies within the plane of the focal point 21 of the reflector 20. The configuration of FIG. 1 is therefore that of an FAFR system.

Figure 2:
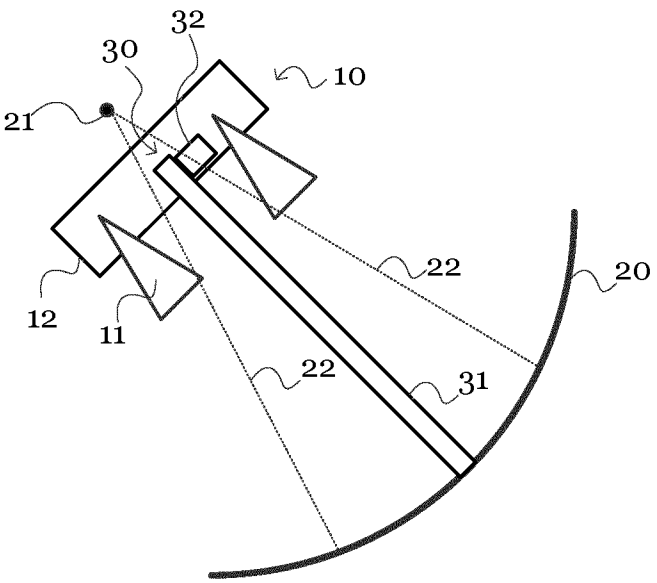
FIG. 2 illustrates an AFR assembly according to embodiments of the present invention in a defocused configuration.

FIG. 2 illustrates the AFR assembly of FIG. 1 in which the telescopic arm 31 has contracted, relative to its expanded position in FIG. 1. The contraction of the telescopic arm 31 has the effect that the focal point 21 of the reflector 20 is behind the feed array 10, such that the configuration of FIG. 2 is that of a DAFR system. In the DAFR system, several feeds 11 contribute to the formation of one beam, managed by the beamforming network.

It will be appreciated that a number of modifications may be made to the configurations illustrated in FIGS. 1 and 2 without departing from the scope of the invention. Such modifications are described below.

Although the telescopic arm 31 is illustrated as coupled to a mounting surface 12 of the feed array 10, it may instead be coupled to a surface on the satellite payload to which the AFR assembly is mounted. The telescopic arm 31 is thus able to move the reflector 20 relative to the feed array 10 without being coupled directly to the feed array 10.

It is described above that the actuator 32 operates effectively to push or pull the reflector 20 away from or towards the feed array 10, but in alternative embodiments, the actuator 32 may be arranged at the reflector 20, such as on a frame of the reflector 20, so that feed array 10 is effectively pushed or pulled relative to the reflector 20. In further embodiments, actuators may be arranged at both at the reflector 20 and the feed array 10, or may instead be arranged within the telescopic arm 31 itself.

The actuator 32 may be constructed of any suitable form, such as an electromechanical motor or pump, and several actuators may be arranged to control the relative position of the reflector 20 and the feed array 10. Although the embodiments above are described as facilitating relative movement in one direction, namely the direction of the longitudinal extent of the telescopic arm 31, in alternative embodiments, further degrees of freedom of relative movement can be achieved by arranging actuators in different axial orientations or through use of multi-dimensional actuators and gimbals. This enables relative tilting of the reflector 20 and feed array 10 orientations as well as movement in the longitudinal direction.

It will be appreciated that any suitable alternative to a telescopic arm/actuator system may be employed in further embodiments which enable the required relative motion of the reflector and feed array. For instance, a series of cables and pulleys may couple the frame of the reflector 20 to a structure in order to pull it towards or release it from the feed array 10. A pivoting arm system with the pivot coupled to, for example, a satellite payload may, enable relative motion based on an opening or closing of two pivoting arms relative to each other, one arm coupled to the feed array 10 and the other arm coupled to the reflector 20.

The mechanism 30 may be configured to have a range of movement such that the AFR antenna can be arranged in a fully focused configuration, a fully defocused configuration, or an intermediate position, but it is also possible for more restricted mechanisms to be used in cases where full flexibility is not required. For example, the mechanism 30 may have a range of movement enabling the AFR antenna to be zoomed only between a fully focused configuration and an intermediate position, or only between an intermediate position and fully defocused position, or between two intermediate positions, dependent on system requirements, provided the range of movement is sufficient to satisfy the desired flexibility of the mission requirements.

In FAFR mode, the beamforming is at its simplest, enabling a beamforming network to generate the maximum number of beams using the fewest number of feeds 11 per beam. The reason for this is that the directivity is maximised when the feed array 10 is at the focal point 21 of the reflector 20, such that RF signals are conveyed between the smallest portion of the feed array 10 (namely that around the focal point) and the reflector 20, in contrast to defocused arrangements where the signals cover a larger area of the feed array 10. In DAFR or IPA modes, the beamforming is more complex, with an increased number, or in some cases, all feeds 11 required in order to contribute to each transmit or receive beam. Power pooling is, however, increased which enables efficient generation of a smaller number (including just one) of spot beams or a contoured beam while maintaining efficient use of available power. Maximisation of the number of feeds 11 also maximises the available signal amplification given that each feed 11 is typically associated with its own respective amplifier.

For a given number of feeds 11, the maximum directivity achievable in any given spot beam is approximately inversely proportional to the solid angle subtended by the specified coverage area. Consequently, embodiments of the present invention enable reconfiguration between low (wide angle and low gain) and high (narrow angle and high gain) magnification IPA modes, so that with a given number of feeds 11, the antenna may generate either medium-directivity beams over a wide field of view, or high-directivity beams over a narrower field of view.

As described above, the control signal which drives one or more of the actuators for controlling the relative position of the reflector 20 and the feed array 10 may be such that it can facilitate control of the AFR antenna in-orbit, which enables reconfiguration within a particular mission. Consequently, the capability of a particular mission is increased, and the number of satellite repositioning manoeuvres that might otherwise be required to bring a particular AFR antenna into service can be reduced.

An example of where such in-orbit flexibility is advantageous is the case of Geosynchronous Earth Orbit (GEO) satellites moved between different regions, where coverage requirements may vary. Another example is in the case of a satellite in a non-circular orbit, where the apparent size of the coverage area changes with time as a result of the angle of the beams relative to the Earth's surface.

It will be appreciated that it is possible for the focal point 21 of the reflector 20 to be positioned both in front of, and behind the feed array 10 within the zoomable range of the mechanism. For instance, in a compact arrangement when the reflector 20 is close to the feed array 10, the focal point 21 may be behind the feed array 10. When the reflector 20 is far from the feed array 10, the focal point 21 may be in front of the feed array 10, which can avoid blockage between the beam reflected from the reflector 20 and the feed array 10. When the reflector 20 is positioned such that its focal point 21 is furthest from the feed array 10, which may occur when the reflector 20 itself is at its maximum distance from the feed array 10, this maximum state of defocus imposes a maximum size requirement on the reflector 20 in cases where a large number of feeds 11 of the feed array 10 are employed, compared with the size of the reflector 20 that would be required when employing the same number of feeds 11 in FAFR mode. The reflector 20 of the AFR antenna of embodiments of the present invention can therefore be considered as "oversized" in the sense that it has a size which may not be required for use in all configurations, but which ensures that the reflector 20 is able to operate in all required configurations.

More generally, mission requirements include the desired coverage size of the AFR antenna, the physical beam size, and its directivity, influence the reflector size in conjunction with the number of feeds to be used.

For instance, a desired coverage size may require a particular physical beam size and directivity in order for the coverage size to be achieved. The physical beam size and directivity will, in turn, influence the number of feeds or the density and distribution of the feeds in the feed array. This will, in turn, influence the reflector size to be used. For example, for a given number of feeds, reducing the coverage requirement leads to a larger reflector and smaller beams.

As described above, the reflector size may also influence the choice of physical beam size and directivity, by specifying a particular level of defocus which can be achieved for a given number of feeds. The specific design of the AFR antenna, and the de-focalisation to be achieved, is therefore dependent on a number of factors, and the relative prioritisation of those factors.

In summary, focused configurations result in better directivity and carrier to interference ratio. Defocused configuration result in better power pooling, better beamforming flexibility, and a better ability to from non-regular Effective Isotropic Radiated Power (EIRP) over the coverage area.

Embodiments of the present invention therefore able coverage to be reduced in-orbit with smaller beams and more directivity. Conventionally, smaller coverage could only be achieved via beamforming network control without changing the beam size or directivity. Embodiments of the present invention also enable focusing operations to be applied to a very-defocused AFR configuration (vD-AFR), with enables directivity when no flexibility in the beamforming is required. Conventionally, a vD-AFR could use only a few elements per beam, at the expense of a directivity penalty. Starting with a slightly defocused AFR system, further defocusing is also possible when flexibility in the beamforming is required.

In the embodiments illustrated with respect to FIGS. 1 and 2, a paraboloidal reflector 20 is shown. Such a paraboloidal reflector 20 is also referred to herein as an "unshaped" reflector. The reflector 20 is illustrated as having a single focal point 21, but it will be appreciated that the size of the feed array 10 is larger than a single point, such that some feed horns 11 in the array will not be positioned at the focal point 21 itself. For this reason, references to the "focal point" above shall be considered as references to a "focal plane", such that it is possible to position the feed array 10 at the distance from the reflector 20 represented by points in a plane containing the focal point 21 of the reflector.

In alternative embodiments, the reflector 20 need not be paraboloidal, and additionally, need not have a single focal point 21. Such non-paraboloidal reflectors are referred to herein as "shaped" reflectors. Depending on the specific shape of the reflector, the focal action of the reflector may be characterised in terms of a series of focal points, or a focal "region". Herein, the generalisation "focal region" will be used to refer to a focal point, an area comprising a plurality of focal points, or a focal plane.

There are increasing requirements that antenna coverage is divided into regions with differing performance requirements, including coverage regions far from the main area (for instance, Hawaii in US systems, and Atlantic islands in European systems). In conventional systems, this often results in sparse feed arrays containing elements widely separated from the main cluster, causing difficulty with accommodation of the feed array on the spacecraft (for example, feeds are required to be positioned outside the envelope of the spacecraft, the Hawaiian feed having to be deployed on a boom, etc).

In embodiments of the present invention, a shaped reflector enables generation of multiple spot beams from an active feed, at least partially decoupling the geometry of the beam distribution from the geometry of the feeds. In the example set out above, a reflector shape should optimally be such that multi-beam coverage can be obtained from a compact and/or regular feed array with simplified spacecraft accommodation. For example, an appropriately shaped reflector can enable use of a generic shape, such as circular, hexagonal or square, for the feed array, while enabling full coverage of an irregular geographical area, thus ensuring that it is not necessary to increase the overall number of feeds in order to achieve the required coverage.

Further flexibility of the AFR antenna, according to embodiments of the present invention, may be achieved by enabling the surface of the reflector to be reconfigurable in addition to, or in some comparative examples, instead of, the zoomable functionality described above.

Figure 3:
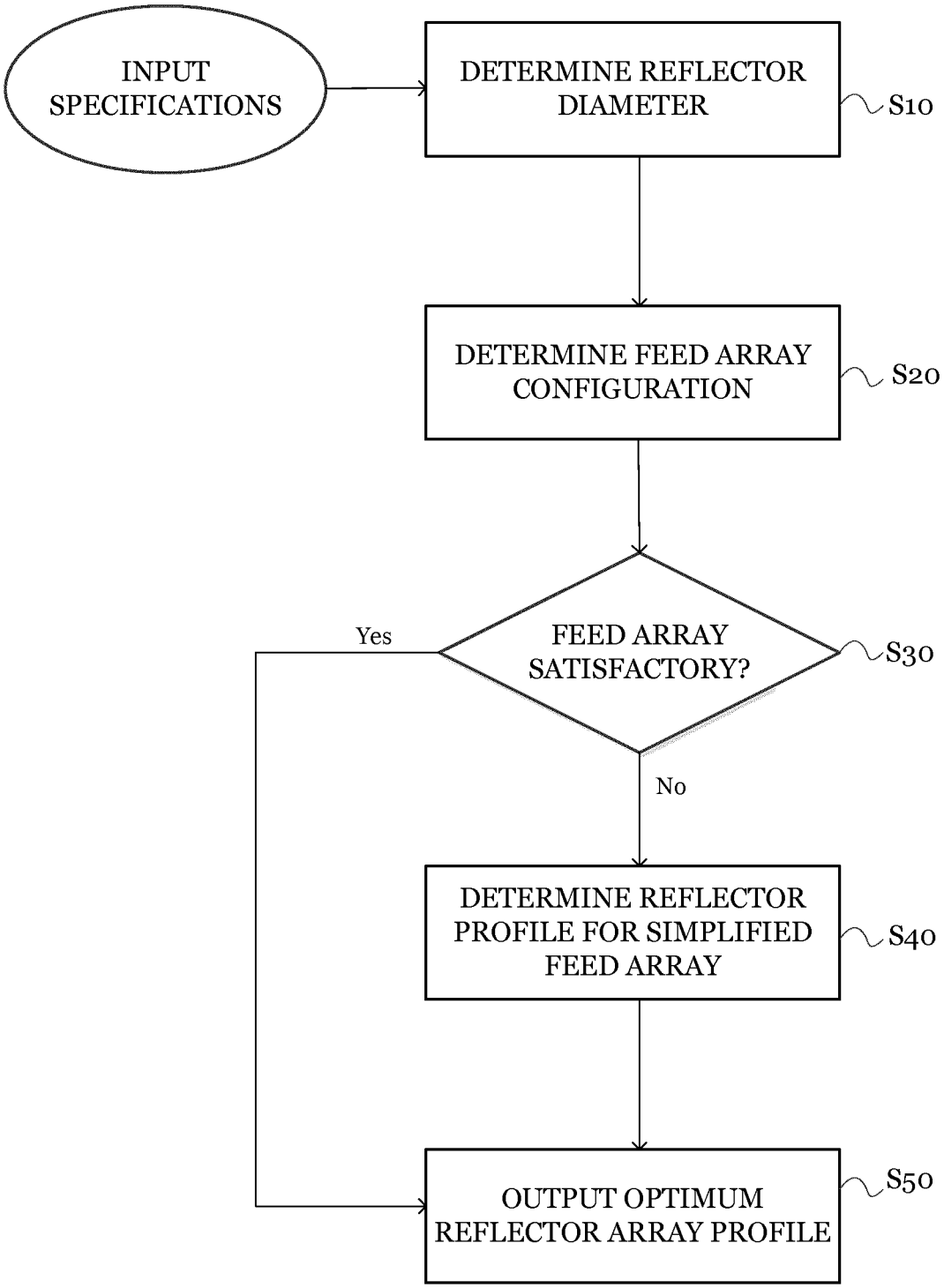
FIG. 3 illustrates a process according to embodiments of the present invention for optimising the shape of an AFR antenna reflector.

FIG. 3 illustrates a process according to embodiments of the present invention for optimising the shape of an AFR antenna reflector.

The optimisation process takes as its inputs a specification of a coverage envelope, and information relating to a directivity requirement for individual spot beams, a frequency reuse scheme, any physical accommodation constraints on the feed array (such as the launcher envelope etc), and the availability of existing feed arrays (referred to herein as a "heritage" requirement, representing non-recurring engineering cost savings).

The optimisation process operates firstly to determine S10 the reflector diameter required to achieve a desired beam directivity and frequency reuse. In addition, the optimisation process operates to determine S20 the number of elements of the feed array, and their layout, which would be required to be used in conjunction with a standard paraboloidal reflector of the determined diameter.

It is determined in step S30 whether the determined feed array specification is satisfactory. If the feed array specification is unsatisfactory (for example, when compared with an accommodation or heritage requirement), a process is performed S40 to determine the optimum reflector profile which would enable the feed array layout to be adjusted (through simplification) meet the required specification. If the feed array is satisfactory, the method proceeds to step S50.

Determination of the optimum reflector profile can be carried out in a single process in which the entire antenna synthesis process is embedded in a parameterized shaping optimisation, but a quicker technique is to apply a reflector shape synthesis method to a beam shape determined for a single reflector element based on quadratic programming methods. Constraints may also be applied to the shaping optimisation process, associated with physical limitations of the reflector technology, which will typically depend on the frequency band to be used.

The output of the optimisation process is thus a specification of an optimum shaped reflector, to be used in conjunction with a simplified (for example, a generic or semi-generic heritage) feed array.

Figure 4:
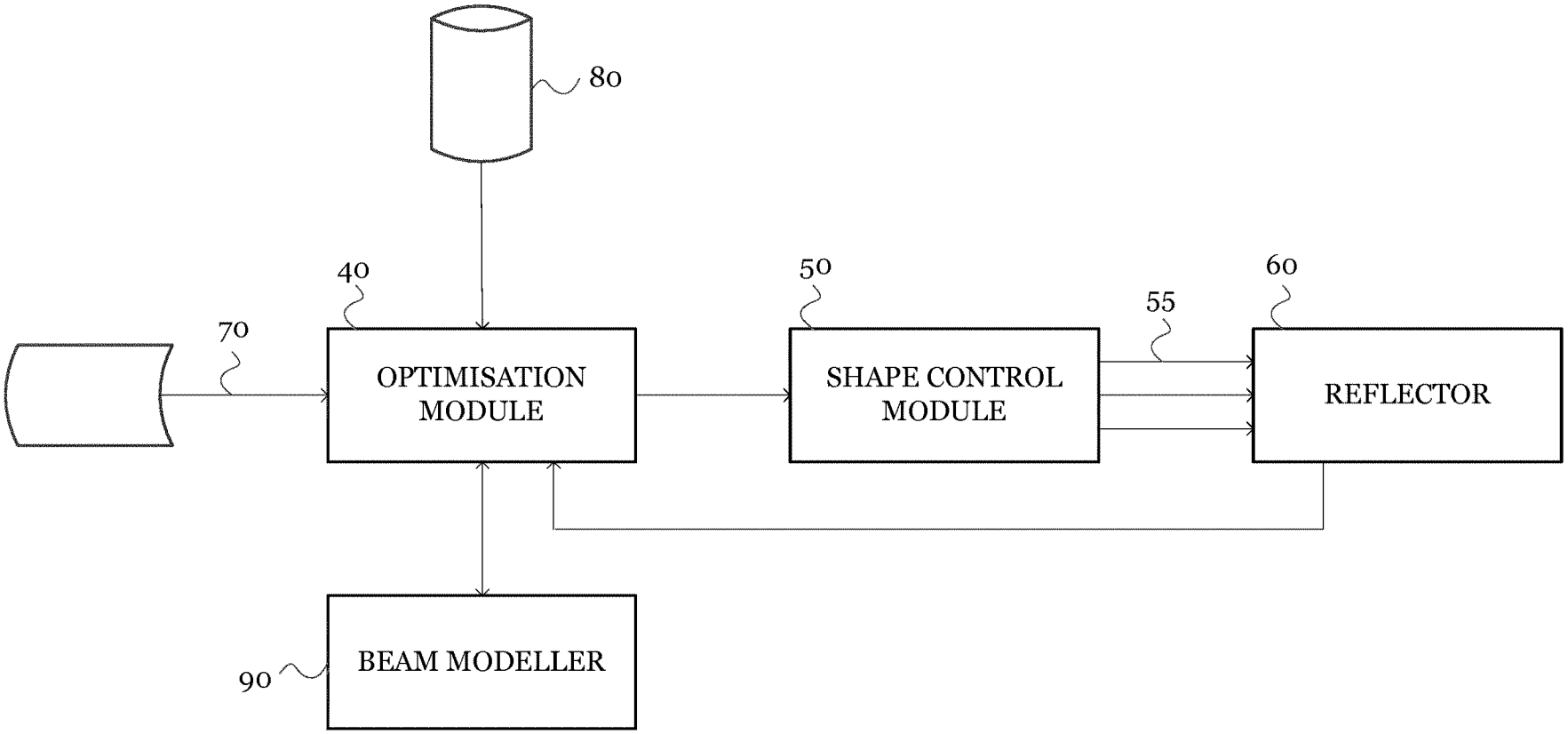
FIG. 4 illustrates a system, according to embodiments of the present invention, for dynamically optimising the shape of an AFR antenna reflector in-orbit.

FIG. 4 illustrates a system, according to embodiments of the present invention, for dynamically optimising the shape of an AFR antenna reflector in-orbit.

The system comprises an optimisation module 40 for determining an optimum reflector profile, and a shape control module 50 for translating an optimum profile into a series of actuation signals 55 representing a shaping function to be applied to the reflector 60 to adjust its surface profile accordingly.

The optimisation module 40 takes inputs from a control signal 70 received from a ground station, or via the antenna uplink or an inter-satellite link, and also takes inputs representing sensors on the reflector surface which report the current configuration of the reflector 60 and its relative position from its feed array. The distance may, for example, be determined by a laser-based range-measurement system. Such a measurement system may be incorporated in the mechanisms of the embodiments shown in FIGS. 1 and 2 in order to verify the correct operation of, for example, the telescopic arm 31. The optimisation module 40 applies an analogous process to that illustrated in FIG. 3, but whereas the process of FIG. 3 simulates aspects of the AFR antenna which need to be fixed prior to launch of the AFR antenna from Earth, such as the reflector diameter and the feed array shape, the process of FIG. 4 models an optimum shape given a particular reflector diameter and feed array, based on the mission requirements, determined from the control signal 70 and a required operating position or range of adjustment of the reflector position relative to the feed array in the manner described in the embodiments above.

In the embodiments described above, it is specified that mission requirements may be received by the AFR assembly payload host on an ongoing basis. In alternative embodiments, a series of mission requirements may be uploaded once, at the start of the mission, and then accessed either periodically or at predetermined times, from a control mechanism in the payload, and input to the optimisation module.

The optimisation module 40 is configured with information which specifies the available profiles of the reflector—this may take the form of a discrete set of profiles, from which an optimum selection is to be made, or may specify the division of a reflector surface into elements and the relative movement of adjacent elements which can be achieved in order to create a particular surface profile. Such information is obtained from a database 8*o*, either on-board the satellite payload hosting the AFR antenna, or on the ground, specifying reflector configurations for various manufacturers and models. As an example, a reflector to be used with Ku-band radiation may have a diameter of the order of 2.5 metres, and may have an array of 30×30 controllable elements.

The system comprises a beam modeller 90, which is able to simulate the beam shape which can be achieved when a particular reflector profile is used with the feed array at a particular distance from the feed array. The beam modeller has knowledge of the beam forming networks which interface with the feed array, which control the way in which beam forming is applied to signals through the feed array, such that the desired mission requirements on the beamlet shape, coverage area, directivity, power spreading and so on, can be achieved.

The optimisation module 40 interfaces with the beam modeller 90 in order to determine whether adjustment of the reflector surface profile is required at all, or whether a mission requirement can be achieved via an adjustment to the beamforming network, and this is therefore a mechanism to determine whether to implement mission requirements via signal processing or through mechanical system configuration, or a hybrid of the two techniques. It will be appreciated that in certain situations, it may be more efficient to retain a particular physical configuration and to control the beamforming networks to achieve a particular beam shape, for example where relatively small adjustments are required, whereas in other situations, the required adjustment is beyond the scope of what can be achieved through control of the beamforming networks, and focusing or defocusing of the AFR antenna and/or shape adjustment are required instead.

Based on the determined optimum reflector profile, the shape control module 50 applies the required drive signals 55 to one or more actuators associated with the shape of the reflector surface in order to shape the reflector surface accordingly.

The components shown in FIG. 4 may be embodied in hardware, software, or a combination of the two. Although FIG. 4 illustrates separate components, one or more of the components may be integrated with each other, or with the master controller on-board the satellite payload.

As described above, embodiments of the present invention may facilitate switching between different focal configurations, and between high and low magnification modes. In both cases, where a particular reflector surface profile is to be selected for a range of operation between focal configurations or magnification modes, specific shaping functions are preferably applied to the reflector to achieve the best compromise between performance across the entire operating ranges and desirable antenna characteristics.

It will be appreciated that a number of modifications can be made to the embodiments described above without departing from the scope of the claims. The modifications will be dependent on mission requirements, and particularly the dynamic nature of such requirements, and suitable adjustments to the means of adjusting the relative position of the reflector and the feed array, and suitable reflector shapes, sizes and feed array configurations can be selected according to the desired operation of the AFR assembly.

The invention claimed is:

1. An array-fed reflector (AFR) antenna assembly, comprising:

an AFR antenna comprising:

a feed array comprising a plurality of feeds;

a feed array mount;

a non-paraboloidal single reflector;

a beamforming network; and a mechanism, coupling the reflector to the feed array mount, configured to move a position of the single reflector relative to a position of the feed array such that a focal region of the single reflector is movable with respect to the position of the feed array;

wherein the profile of the single reflector surface is shaped such that each feed of the feed array generates a plurality of beams;

wherein the mechanism is arranged to move the position of the single reflector relative to the position of the feed array such that the AFR antenna has a fully focused AFR configuration, a fully defocused AFR configuration, and a partially defocused AFR configuration; and wherein, when the AFR antenna is configured as a partially defocused AFR or a fully defocused AFR, the beamforming network is arranged to synthesize beams by weighting signals from subsets of the plurality of feeds.

2. An AFR antenna assembly according to claim 1, wherein the mechanism comprises a telescopic arm coupling the single reflector to the feed array mount such that the single reflector is zoomable relative to the feed array.

3. An AFR antenna assembly according to claim 2, wherein the single reflector has a size configured based on a maximum distance between the single reflector and the feed array provided by the telescopic arm.

4. An AFR antenna assembly according to claim 1, wherein the mechanism comprises means for tilting the orientation of the single reflector relative to the orientation of the feed array.

5. An AFR antenna assembly according to claim 1, comprising means for applying a shaping function to the surface of the single reflector, wherein the means for applying a shaping function comprises one or more actuators coupled to one or more movable sections of the single reflector surface.

6. A system comprising:

an AFR antenna assembly according to claim 1; and a control means for receiving a signal from a ground station for controlling driving of the mechanism.

7. A system according to claim 6, further comprising:

optimisation means for determining an optimum shaping function for the surface of the single reflector based on the relative position of the single reflector and the feed array.

8. An AFR antenna assembly according to claim 2, wherein the mechanism further comprises means for tilting the orientation of the single reflector relative to the orientation of the feed array.

9. An AFR antenna assembly according to claim 3, wherein the mechanism further comprises means for tilting the orientation of the single reflector relative to the orientation of the feed array.

10. An AFR antenna assembly according to claim 2, comprising means for applying a shaping function to the surface of the single reflector, wherein the means for applying a shaping function comprises one or more actuators coupled to one or more movable sections of the single reflector surface.

11. An AFR antenna assembly according to claim 3, comprising means for applying a shaping function to the surface of the single reflector, wherein the means for applying a shaping function comprises one or more actuators coupled to one or more movable sections of the single reflector surface.

12. An AFR antenna assembly according to claim 4, comprising means for applying a shaping function to the surface of the single reflector, wherein the means for applying a shaping function comprises one or more actuators coupled to one or more movable sections of the single reflector surface.

13. A system comprising:

an AFR antenna assembly according to claim 2; and a control means for receiving a signal from a ground station for controlling driving of the mechanism.

14. A system comprising:

an AFR antenna assembly according to claim 3; and a control means for receiving a signal from a ground station for controlling driving of the mechanism.

15. A system comprising:

an AFR antenna assembly according to claim 4; and a control means for receiving a signal from a ground station for controlling driving of the mechanism.

16. A system comprising:

an AFR antenna assembly according to claim 5; and a control means for receiving a signal from a ground station for controlling driving of the mechanism.

17. A system comprising:

an AFR antenna assembly according to claim 8; and a control means for receiving a signal from a ground station for controlling driving of the mechanism.

* * * * *